US008375967B1

(12) United States Patent
Stratton et al.

(10) Patent No.: US 8,375,967 B1
(45) Date of Patent: Feb. 19, 2013

(54) WALKING AID WITH IRRITANT DISPENSER

(76) Inventors: Shane Stratton, Kalispell, MT (US); Sean Patterson, Columbia Falls, MT (US)

( * ) Notice: Subject to any disclaimer, the term of this patent is extended or adjusted under 35 U.S.C. 154(b) by 0 days.

(21) Appl. No.: 13/217,352

(22) Filed: Aug. 25, 2011

(51) Int. Cl.
*A45B 3/00* (2006.01)

(52) U.S. Cl. ..... 135/66; 135/83; 280/816; 222/174; 222/192

(58) Field of Classification Search ..... 135/65–66, 135/77, 83; 280/819, 821, 816; 222/76, 222/96, 174, 182, 191–192, 617
See application file for complete search history.

(56) References Cited

U.S. PATENT DOCUMENTS

| | | | | | |
|---|---|---|---|---|---|
| 2,385,091 | A * | 9/1945 | Lukowitz | 472/52 |
| 2,438,014 | A * | 3/1948 | Lukowitz | 135/66 |
| 3,038,483 | A * | 6/1962 | Altsheler | 135/16 |
| 3,443,820 | A * | 5/1969 | Baker | 280/816 |
| 4,252,137 | A * | 2/1981 | Cohen | 135/69 |
| 4,967,684 | A * | 11/1990 | Vidovic et al. | 116/142 FP |
| 5,065,904 | A * | 11/1991 | McCaffrey et al. | 222/3 |
| 5,429,389 | A * | 7/1995 | Shandell | 280/821 |
| 5,839,461 | A | 11/1998 | Lambeth, Jr. | |
| 5,842,601 | A | 12/1998 | Pierpoint | |
| 5,901,723 | A | 5/1999 | Ames | |
| 6,390,336 | B1 * | 5/2002 | Orozco | 222/162 |
| 6,957,750 | B1 | 10/2005 | Trudell | |
| 7,654,275 | B2 * | 2/2010 | Ewell et al. | 135/66 |
| 7,717,300 | B1 * | 5/2010 | Yarrusso, Jr. | 222/174 |

* cited by examiner

*Primary Examiner* — Winnie Yip
(74) *Attorney, Agent, or Firm* — Dale J. Ream

(57) ABSTRACT

A walking aid with irritant dispenser includes a shaft having upper and lower ends and defining a hollow chamber configured to contain an irritant. A compressed air cartridge is positioned in the shaft in fluid communication with the chamber. A trigger is operatively coupled to the air cartridge and configured to cause air to be released from the cartridge into the chamber when actuated. A piston situated in the chamber is movable between an upward configuration when the trigger is not actuated and a downward configuration when the trigger is actuated. The lower end of the shaft defines an outlet in fluid communication with the chamber through which the irritant is released when the piston is at the downward configuration. The chamber includes a predetermined amount of fluid pressure such that infusion of air from the compressed air cartridge increases the pressure and urges the piston toward the downward configuration.

13 Claims, 4 Drawing Sheets

WALKING AID WITH IRRITANT DISPENSER

BACKGROUND OF THE INVENTION

The present invention relates generally to mobility enhancing devices and, more particularly, to a walking aid having a pepper spray dispenser. The walking aid may be a walking stick having a reservoir containing an eye irritant that may be used defensively to dispense an irritant such as pepper spray into the face of an attacking animal such as a bear.

Hiking in mountainous, woody, or rocky regions is often made difficult or even dangerous due to roughness or instability of the ground or rocky surface. Wearing hiking boots or other appropriate footwear is often considered essential in order to maintain safe footing while hiking. In addition, using a walking stick or other mobility device is often desirable to maintain a safe footing on unstable terrain. The walking stick is usually a generally straight pole and preferably includes a pointed end that lightly penetrates the ground in order to enhance balance and stability while walking on uneven or unstable ground. Another problem sometimes encountered by hikers in some geographical regions of the United States is an encounter with a grizzly or brown bear although such an encounter is still pretty rare. Most hikers would rather avoid contact with the ferocious animal or at least have a credible opportunity to scare the animal away or distract the animal long enough to escape.

Various devices have been proposed in the art for providing walking assistive devices, such as canes, having an irritant dispenser. The prior patents present slidable, spring-activated, and pressurized canister structures for causing an irritant to be expelled from a cane, nightstick, or the like, as shown in U.S. Pat. No. 5,901,723, U.S. Pat. No. 5,842,601, and U.S. Pat. No. 6,957,750. Although assumably effective for their intended purposes, the existing devices do not provide a pressure regulated system for forcibly emitting a steady pressurized stream of irritant so long as a trigger is actuated. Further, the existing devices do not provide a structure in which a nozzle situated adjacent a lower end of the walking device is prevented from becoming plugged up. In addition, the existing devices do not provide a walking aid having a spear that is effective both as a walking aid and as a weapon against ferocious animals.

Therefore, it would be desirable to have a walking aid that overcomes the limitations of the existing devices and prior patent proposals.

SUMMARY OF THE INVENTION

A walking aid with an irritant dispenser according to the present invention includes an elongate shaft having upper and lower ends and a hollow chamber between the upper and lower ends configured to contain an irritant. A compressed air cartridge is positioned in the shaft upwardly adjacent the shaft upper end and in fluid communication with the chamber. A trigger is situated on an outer surface of the shaft and operatively coupled to the air cartridge and configured to cause air to be released from the cartridge into the chamber when actuated. A piston situated in the chamber is movable between an upward configuration when the trigger is not actuated and a downward configuration when the trigger is actuated. The lower end of the shaft defines an outlet in fluid communication with the chamber through which the irritant is released when the piston is at the downward configuration. The chamber includes a predetermined amount of fluid pressure such that infusion of air from the compressed air cartridge into an upper portion of the chamber increases the fluid pressure therein and urges the piston toward the downward configuration.

Therefore, a general object of this invention is to provide a walking aid with an irritant dispenser for assisting the mobility and traction of a hiker and providing a defensive weapon against an attacking animal.

Another object of this invention is to provide a walking aid, as aforesaid, having a shaft that defines a chamber containing an irritant such as pepper spray.

Still another object of this invention is to provide a walking aid, as aforesaid, having a compressed air cartridge configured to selectively infuse pressurized air into the chamber so as to forcefully eject the irritant through a nozzle in the lower end of the shaft.

Yet another object of this invention is to provide a walking aid, as aforesaid, having a trigger configured to selectively actuate the air cartridge to release compressed air into the chamber.

A further object of this invention is to a walking aid, as aforesaid, having a spear extending downwardly from a lower end of a shaft configured to provide enhanced traction to a hiker and to provide a defensive weapon against an attacking animal.

A still further object of this invention is to provide a walking aid, as aforesaid, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
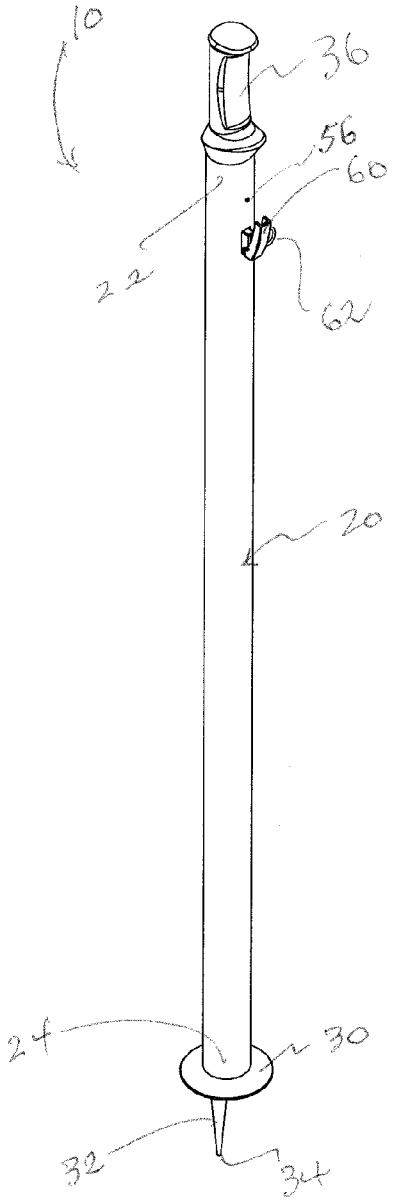
FIG. 1 is a perspective view of a walking aid having an irritant dispenser according to a preferred embodiment of the present invention.

A walking aid with a pepper dispenser according to a preferred embodiment of the present invention will now be described with reference to FIGS. 1 to 6D of the accompanying drawings. The walking aid 10 includes an elongate shaft 20 having a fluid chamber 40 configured to contain an irritant under pressure, a compressed air cartridge 50, and trigger 60 for actuating the air cartridge 50 to infuse air into the chamber 40 causing irritant to be sprayed from an outlet 28.

More particularly, the elongate shaft 20 includes upper 22 and lower 24 ends and has a generally linear configuration for use as a walking stick or cane. The shaft 20 is hollow, generally tubular, and defines an open area 26 adjacent the upper end 22 (FIGS. 5C and 6C) configured to contain various functional components that will be described in more detail later.

The fluid chamber 40 includes a generally tubular configuration complementary to an interior configuration of the shaft 20 and, in fact, may be defined thereby. Preferably, the chamber 40 extends between the open area 26 of the shaft 20 to the shaft lower end 24 and is constructed to contain a predetermined volume of irritant, such as pepper spray, without leaking. The chamber 40 has a predetermined fluid pressure depending the amount of irritant stored therein. It is understood that the fluid pressure is increased as more irritant is included in the chamber 40 and as compressed air is infused therein as described below. The lower end 24 of the shaft 20 defines an outlet 28 in fluid communication with the chamber 40 through which irritant may be sprayed or otherwise emitted. The shaft 20 may include a base 30 having a circular or wider profile through which the outlet 28 extends. The outlet 28 may be a spray nozzle.

The compressed air cartridge 50 may be situated in the open area 26 adjacent the shaft upper end 22. The air cartridge 50 may be a 16 gram $CO^2$ tank although other sizes or types of compressed air containers may also be suitable. The air cartridge 50 is configured so that compressed air stored therein may be transmitted into the chamber 40 when actuated.

The trigger 60 is attached to an outer surface of the shaft 20 and operatively coupled to the air cartridge 50. The trigger 60 is selectively movable from a disengaged configuration not actuating the air cartridge 50 to an engaged configuration that actuates the air cartridge 50 to release compressed air into the chamber 40. The trigger 60 may include a stop 62, such as a pin, that prevents movement of the trigger 60 to the engaged/actuated configuration until the stop 62 is removed. For example, a user must first remove the pin 62 from the trigger 60 before the trigger 60 may be operated to actuate a dispensing of the irritant.

A piston 42 is situated in the chamber 40 and configured to move between an upward configuration when the trigger 60 is at the disengaged configuration and a downward configuration when the trigger 60 is at the engaged configuration. The piston 42 is normally at the upward configuration. It should be understood that the chamber 40 of irritant is under pressure. When the trigger 60 is engaged to actuate the air cartridge 50 to infuse air into an upper portion 41 of the chamber 40, the pressure is increased and the increase in pressure urges the piston 42 from the normally upward configuration toward the downward configuration. As the piston 42 is urged toward the downward configuration, the irritant beneath the piston 42 is compressed, i.e. the pressure beneath the piston 42 is increased. A relief valve 44 is situated adjacent the lower end 24 of the shaft and, therefore, adjacent the shaft outlet 28. The relief valve 44 is opened when a predetermined amount of pressure is experienced such that irritant is sprayed or otherwise emitted from the outlet 28.

Figure 5A:
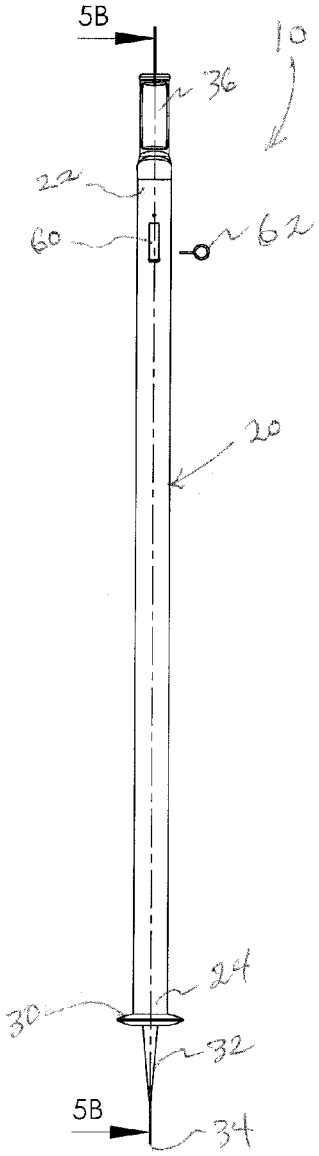
FIG. 5A is another front view of the walking aid as in FIG. 1.
Figure 5B:
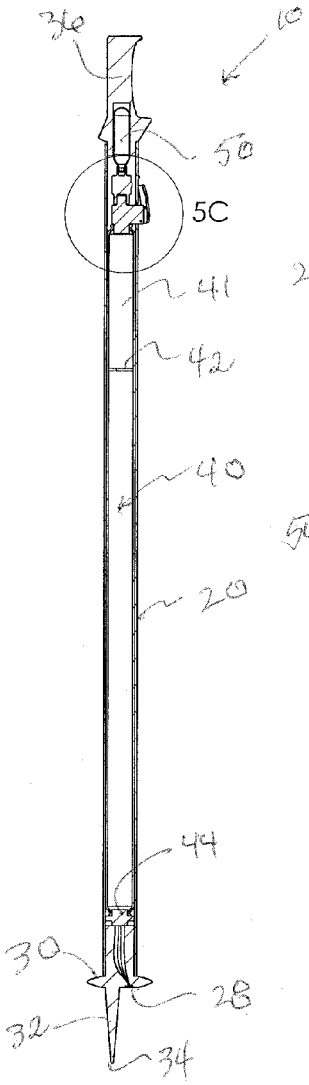
FIG. 5B is a sectional view taken along line 5B-5B of FIG. 5A showing the trigger in an engaged configuration and the piston in a downward configuration.
Figure 5C:
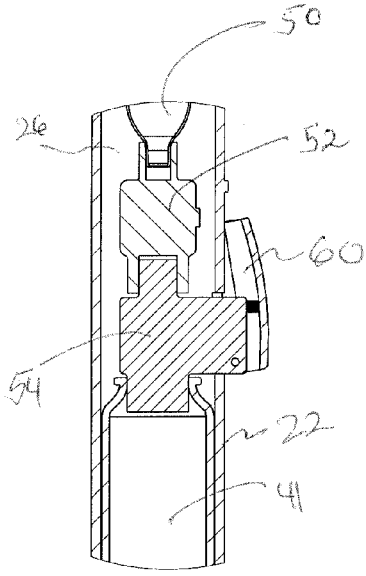
FIG. 5C is an isolated view on an enlarged scale taken from FIG. 5B.
Figure 6A:
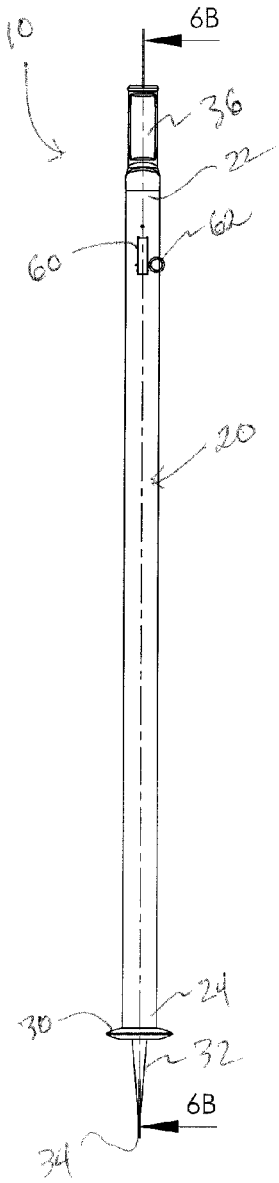
FIG. 6A is another front view of the walking aid as in FIG. 1.
Figure 6B:
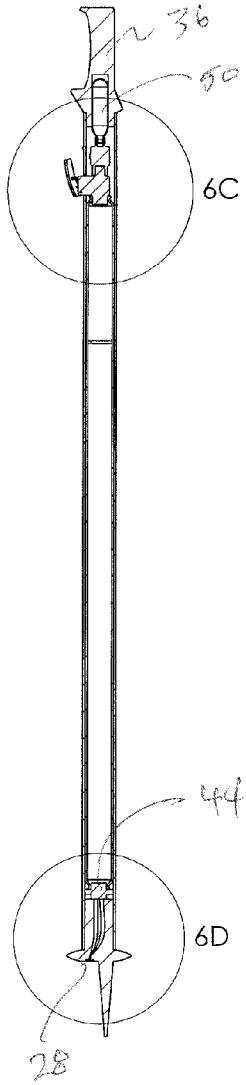
FIG. 6B is a sectional view taken along line 6B-6B of FIG. 6A showing the trigger in an unengaged configuration and the piston in a upward configuration
Figure 6C:
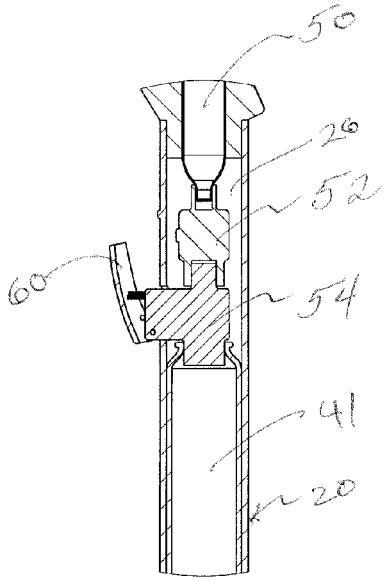
FIG. 6C is an isolated view on an enlarged scale taken from FIG. 6B
Figure 6D:
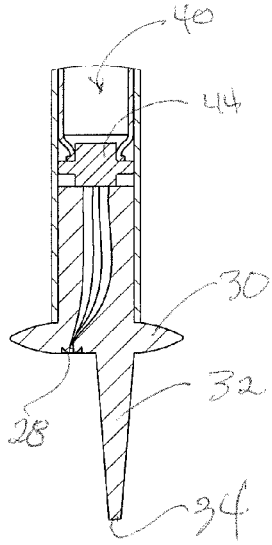
FIG. 6D is an isolated view on an enlarged scale taken from FIG. 6B.
Figure 1:
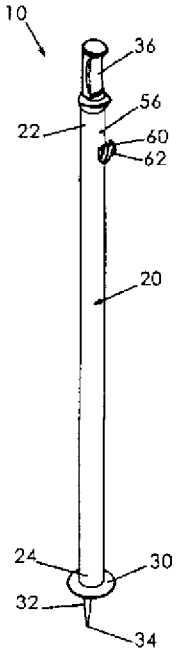
Figure 2:
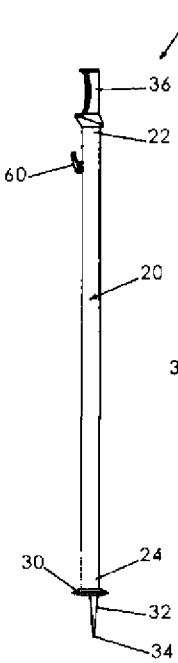
Figure 3:
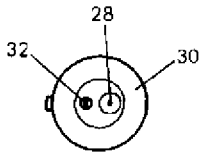
Figure 4A:
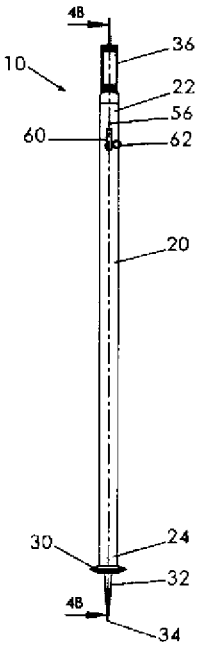
Figure 4B:
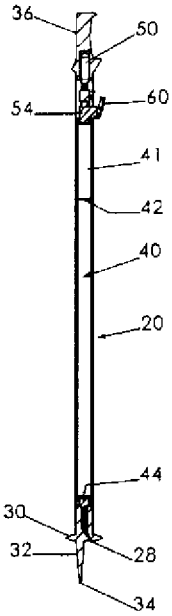
Figures 5A, 5B, 5C:
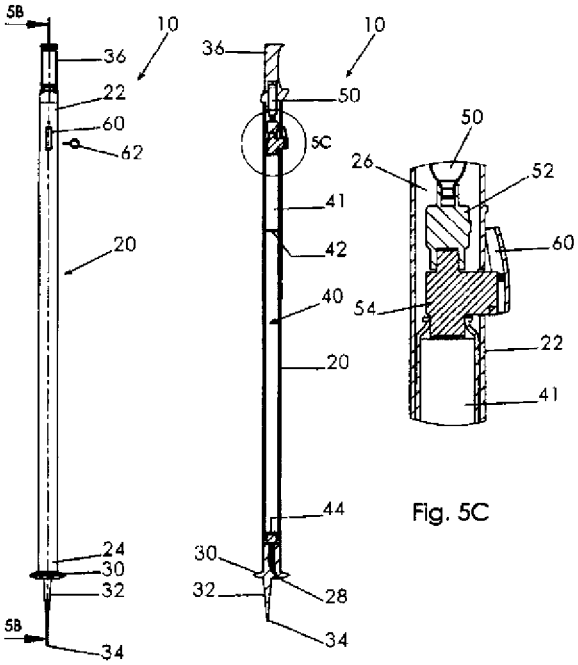
Figures 6A, 6B, 6C, 6D:
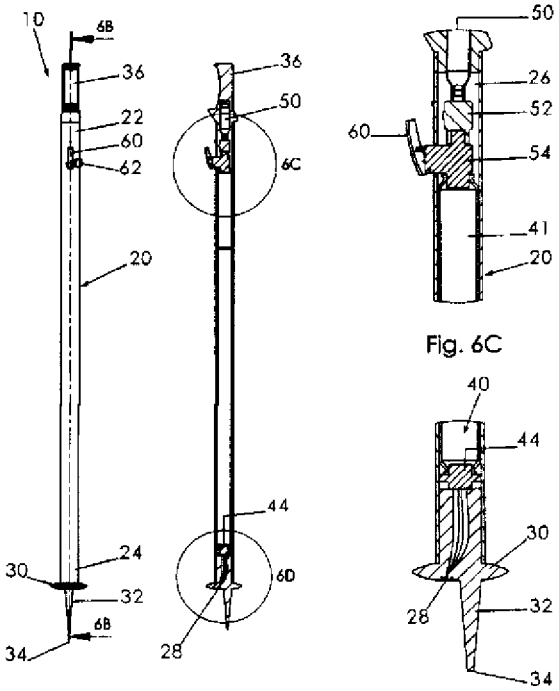

A pressure regulator 52 and a pressure valve 54 are situated in the open area 26 of the shaft 20 and operatively coupled to the air cartridge 50 and positioned intermediate the air cartridge 50 and the irritant chamber 40 (FIG. 5C). The pressure regulator 52 is configured to receive compressed air from the air cartridge 50 when the air cartridge 50 is actuated upon operation of the trigger 60 and release it at a steady, consistent rate. This is advantageous as it ensures that the stream of irritant being emitted from the outlet 28 is steady over an extended period of time rather than just all at once. For instance, the irritant may at first miss the intended target, e.g. an animal's eyes, and needs to continue being emitted at a steady rate as the aim of the shaft 20 is adjusted. The pressure valve 54 selectively opens a channel between the air cartridge 50 and the chamber 40 when a predetermined amount of pressure is sensed. For instance, when the air cartridge is actuated and the resulting air is channeled through the air regulator, the pressure valve 54 opens to allow the compressed air into the chamber 40 so as to push the piston 42 toward the downward configuration as described above.

A visual indicator 56, such as an LED, may be positioned adjacent the pressure regulator 52 and pressure valve 54 and be operatively connected thereto. The visual indicator 56 may be configured to illuminate if a pressure indicative of low pressure is indicated by one of the pressure regulator 52 or the pressure valve 54. Practically, illumination of the pressure indicator 56 is to inform a user that the supply of irritant may be running dangerously low and will be completely expelled very soon if the trigger 60 remains actuated. Alternatively, a pressure indicator may be positioned in the chamber 40 to indicate if the pressure therein is below a predetermined pressure.

A handle 36 may be removably attached to the upper end 22 of the shaft 20, such as by threadable engagement (FIG. 1*a*). Preferably, the handle 36 includes a generally vertical configuration to receive the palm of a user's hand as the walking aid 10 is used as a walking stick although other configurations may also work. Removal of the handle 36 gives access to the air cartridge 50 so that it may be replaced after use.

Further, the base 30 of the walking aid 10 may include a spear 32 extending downwardly therefrom. The spear 32 may include a free end 34 having a pointed configuration displaced from the base 30. It is understood that the free end 34 is configured to be used by a user to provide enhanced traction and stability while walking. Another advantage to the spear 32 is that it keeps the outlet 28 from touching a ground surface and potentially becoming plugged up. In addition, the pointed tip of the spear 32 may be used defensively as a weapon against an attacking animal, to either scare the animal off or actually impart a significant wound. It is advantage that the spear 32 is immediately adjacent the outlet 28 such that the spear 32 and irritant may be used simultaneously to defend against an animal attack. Preferably, the handle 36, shaft 20, and spear 32 are aligned along a common imaginary longitudinal axis.

The walking aid 10 with irritant dispenser may also include a Global Positioning Device (not shown) that is configured to communicate the global position of the walking aid 10 to emergency authorities when activated. In addition, this invention contemplates that the spear 32 may be electrically connected to a battery (not shown) and be selectively energized to impart an electrical shock to an attacking animal simply by touching the animal with the spear tip. Still further, the spear 32 or handle 36 may be configured to include a packet or reservoir containing a quantity of irritant and configured to break off in the mouth of an attacking animal. In use, the packet would immediately break open upon removal from the shaft 20, causing instant irritation to the animal and providing opportunity for escape.

In use, the walking aid 10 with irritant dispenser may be used as a walking stick to enhance the balance and stability of a person while hiking, especially in mountainous or wooded area. The vertical handle 36 and pointed spear 32 are especially advantageous for this purpose. If a ferocious animal is encountered, such as a grizzly bear, the walking aid 10 may be converted quickly into a defensive weapon to scare off the animal or at least to distract the animal long enough that the person may escape. To operate the device, the pin 62 is removed from the trigger 60. Then, the shaft 20 may be pointed spear-end first toward the oncoming animal, such at its eyes. The user may then squeeze the trigger 60 which will actuate the air cartridge 50 to infuse compressed air into the chamber 40. This increase in pressure urges the piston 42 to its downward configuration which forces the pepper spray irritant out of the shaft outlet 28 and onto the attacking animal. As described above, the spear 32 and irritant may be used separately or simultaneously to fend off an attacking animal.

It is understood that while certain forms of this invention have been illustrated and described, it is not limited thereto except insofar as such limitations are included in the following claims and allowable functional equivalents thereof.

The invention claimed is:

1. A walking aid with pepper spray dispenser, comprising:

an elongate shaft having upper and lower ends and defining a hollow chamber between said upper and lower ends configured to contain an irritant;

a compressed air cartridge positioned in said shaft adjacent said shaft upper end and in fluid communication with said chamber;

a trigger attached to said shaft and operatively coupled to said air cartridge, said trigger configured to actuate said air cartridge to release compressed air into said chamber;

a piston situated in said chamber that is movable between an upward configuration when said trigger is not actuated and a downward configuration when said trigger is actuated; and wherein said shaft defines an outlet adjacent said shaft lower end in fluid communication with said chamber through which said irritant is released from said chamber when said piston is at said downward configuration.

2. The walking aid as in claim 1, wherein said irritant is pepper spray.

3. The walking aid as in claim 1, wherein said chamber includes a predetermined amount of fluid pressure such that infusion of air from said air cartridge into an upper portion of said chamber increases said fluid pressure therein and urges said piston toward said downward configuration.

4. The walking aid as in claim 1, wherein said trigger includes a stop configured to prohibit actuation of said trigger until said stop is removed.

5. The walking aid as in claim 4, wherein said stop is a pin coupled to said trigger and configured to prevent movement thereof until said pin is removed from said trigger.

6. The walking aid as in claim 3, further comprising a relief valve situated between aid chamber and said outlet that allows passage of said irritant to said outlet when said chamber pressure is increased.

7. The walking aid as in claim 3, further comprising a spear extending downwardly from said shaft lower end, said spear including a free end having a pointed configuration, said free end being displaced from said lower end.

8. The walking aid as in claim 7, further comprising a handle removably coupled to said shaft upper end.

9. The walking aid as in claim 8, wherein said handle is threadably coupled to said shaft upper end, said open area of said shaft being exposed when said handle is selectively removed.

10. The walking aid as in claim 8, wherein said handle, said, shaft, and said spear are situated along a unitary imaginary longitudinal axis.

11. The walking aid as in claim 10, wherein said spear is substantially adjacent said outlet such that said spear and said irritant may be utilized simultaneously to defend against an animal attack.

12. The walking aid as in claim 3, further comprising:

a pressure regulator positioned in said shaft in operative communication with said air cartridge and with said chamber, said pressure regulator configured to release a consistent stream of air from said air cartridge;

a pressure valve positioned in said shaft in fluid communication with said pressure regulator and said chamber, said pressure valve configured to allow said stream of air into said chamber when a predetermined pressure is indicated; and a visual pressure indicator situated on an outer surface of said shaft that is in operative communication with said pressure regulator and said pressure valve, said pressure indicator configured to be visually indicate if a pressure in one of said pressure regulator or said pressure valve is less than a predetermined pressure.

13. The walking aid as in claim 1, wherein said shaft defines an open area situated between said chamber and said shaft upper end, said compressed air chamber being positioned in said open area.

* * * * *

UNITED STATES PATENT AND TRADEMARK OFFICE

CERTIFICATE OF CORRECTION

PATENT NO. : 8,375,967 B1
APPLICATION NO. : 13/217352
DATED : February 19, 2013
INVENTOR(S) : Shane Stratton and Sean Patterson It is certified that error appears in the above-identified patent and that said Letters Patent is hereby corrected as shown below:

On the title page, replace the informal drawing with the formal drawing of Fig 1.

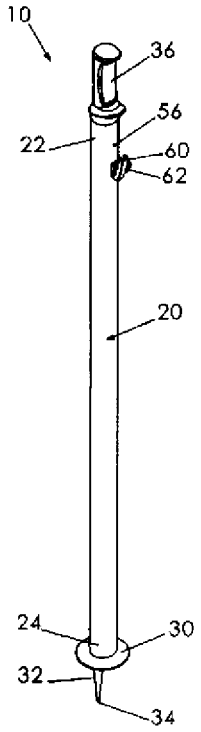

Signed and Sealed this
Second Day of April, 2013

Teresa Stanek Rea
*Acting Director of the United States Patent and Trademark Office*

Figure 2:
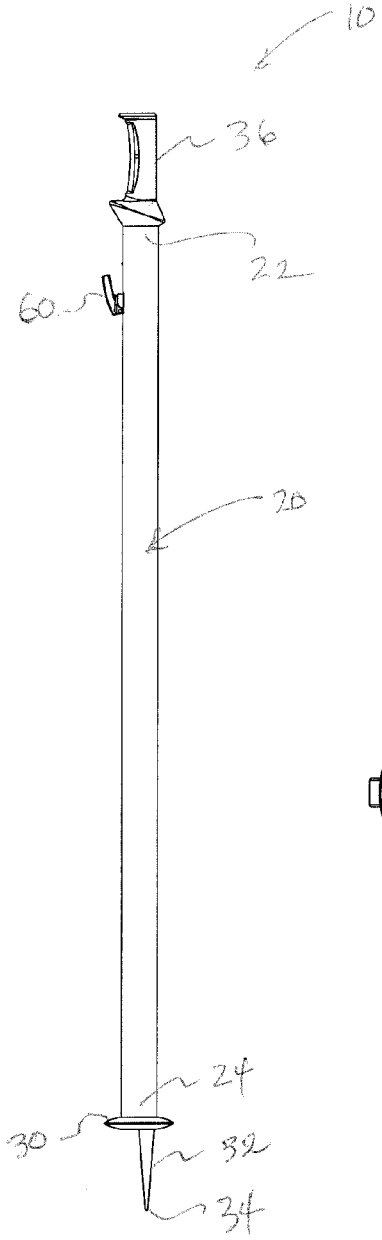
FIG. 2 is a side view of the walking aid as in FIG. 1.
Figure 3:
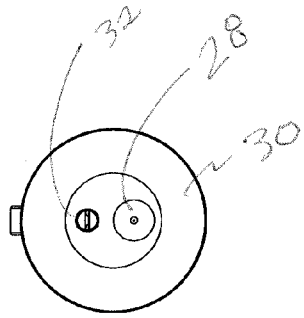
FIG. 3 is a bottom view of the walking aid as in FIG. 1.

On drawing Sheet 1 of 4, replace the informal drawing of Fig. 1, Fig. 2, and Fig. 3 with formal drawing of Fig. 1, Fig. 2, and Fig. 3.

Figure 4A:
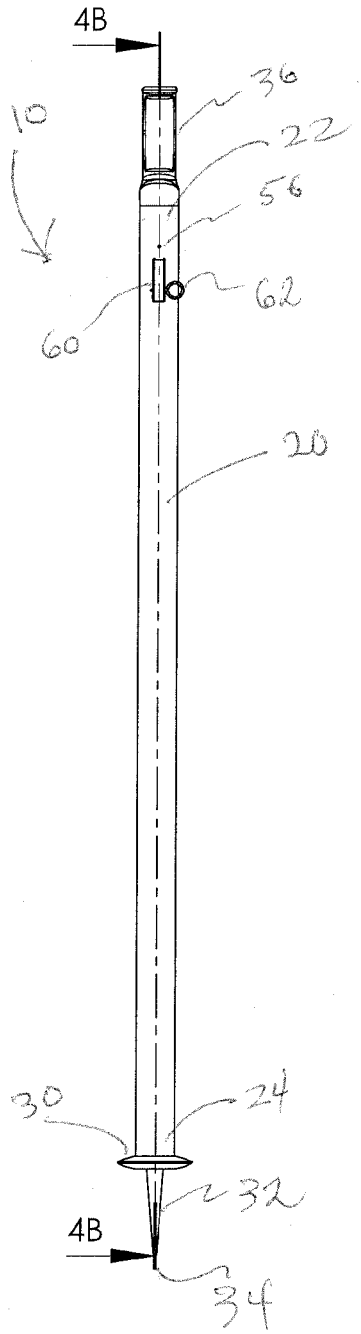
FIG. 4A is a front view of the walking aid as in FIG. 1.
Figure 4B:
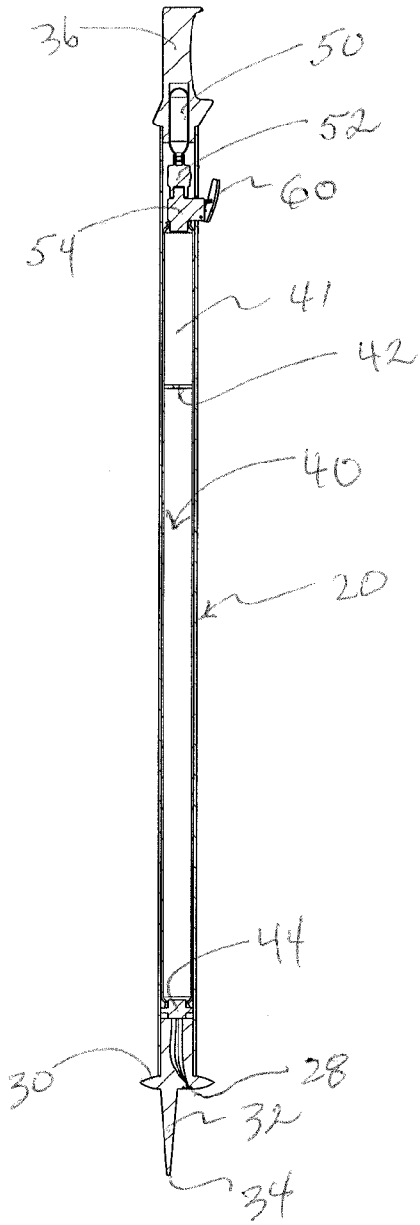
FIG. 4B is a sectional view taken along line 4B-4B of FIG. 4A showing the trigger in an unengaged configuration and the piston in a upward configuration.

On drawing Sheet 2 of 4, replace the informal drawing of Fig. 4A and Fig. 4B with formal drawing of Fig. 4A and Fig. 4B.

On drawing Sheet 3 of 4, replace the informal drawing of Fig. 5A, Fig. 5B, and Fig. 5C with formal drawing of Fig. 5A, Fig. 5B, and Fig. 5C.

On drawing Sheet 4 of 4, replace the informal drawing of Fig. 6A, Fig. 6B, Fig. 6C, and Fig. 6D with formal drawing of Fig. 6A, Fig. 6B, Fig. 6C, and Fig. 6D.

(12) United States Patent
Stratton et al.

(10) Patent No.: US 8,375,967 B1
(45) Date of Patent: Feb. 19, 2013

(54) WALKING AID WITH IRRITANT DISPENSER

(76) Inventors: Shane Stratton, Kalispell, MT (US); Sean Patterson, Columbia Falls, MT (US)

( * ) Notice: Subject to any disclaimer, the term of this patent is extended or adjusted under 35 U.S.C. 154(b) by 0 days.

(21) Appl. No.: 13/217,352

(22) Filed: Aug. 25, 2011

(51) Int. Cl.
*A45B 3/00* (2006.01)

(52) U.S. Cl. ..... 135/66; 135/83; 280/816; 222/174; 222/192

(58) Field of Classification Search ..... 135/65–66, 135/77, 83; 280/819, 821, 816; 222/76, 222/96, 174, 182, 191–192, 617
See application file for complete search history.

(56) References Cited

U.S. PATENT DOCUMENTS

| | | | | | |
|---|---|---|---|---|---|
| 2,385,091 | A * | 9/1945 | Lukowitz | | 472/52 |
| 2,438,014 | A * | 3/1948 | Lukowitz | | 135/66 |
| 3,038,483 | A * | 6/1962 | Altsheler | | 135/16 |
| 3,443,820 | A * | 5/1969 | Baker | | 280/816 |
| 4,252,137 | A * | 2/1981 | Cohen | | 135/69 |
| 4,967,684 | A * | 11/1990 | Vidovic et al. | | 116/142 FP |
| 5,065,904 | A * | 11/1991 | McCaffrey et al. | | 222/3 |
| 5,429,389 | A * | 7/1995 | Shandell | | 280/821 |
| 5,839,461 | A | 11/1998 | Lambeth, Jr | | |
| 5,842,601 | A | 12/1998 | Pierpoint | | |
| 5,901,723 | A | 5/1999 | Ames | | |
| 6,390,336 | B1 * | 5/2002 | Orozco | | 222/162 |
| 6,957,750 | B1 | 10/2005 | Trudell | | |
| 7,654,275 | B2 * | 2/2010 | Ewell et al. | | 135/66 |
| 7,717,300 | B1 * | 5/2010 | Yarrusso, Jr. | | 222/174 |

* cited by examiner

*Primary Examiner* -- Winnie Yip
(74) *Attorney, Agent, or Firm* -- Dale J. Ream

(57) ABSTRACT

A walking aid with irritant dispenser includes a shaft having upper and lower ends and defining a hollow chamber configured to contain an irritant. A compressed air cartridge is positioned in the shaft in fluid communication with the chamber. A trigger is operatively coupled to the air cartridge and configured to cause air to be released from the cartridge into the chamber when actuated. A piston situated in the chamber is movable between an upward configuration when the trigger is not actuated and a downward configuration when the trigger is actuated. The lower end of the shaft defines an outlet in fluid communication with the chamber through which the irritant is released when the piston is at the downward configuration. The chamber includes a predetermined amount of fluid pressure such that infusion of air from the compressed air cartridge increases the pressure and urges the piston toward the downward configuration.

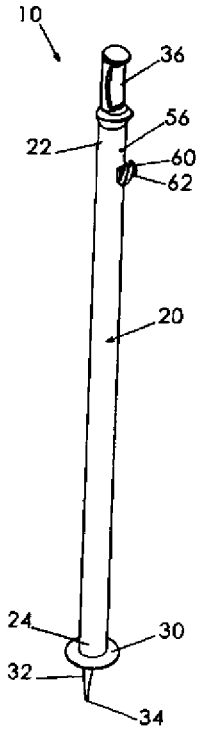

13 Claims, 4 Drawing Sheets